United States Patent [19]

Freeman

[11] Patent Number: 4,909,663

[45] Date of Patent: Mar. 20, 1990

[54] ROAD MAKING APPARATUS

[76] Inventor: Peter D. Freeman, Wirrulla, South Australia, Australia

[21] Appl. No.: 137,865

[22] Filed: Dec. 24, 1987

[51] Int. Cl.[4] ..... E01C 19/26

[52] U.S. Cl. ..... 404/128; 152/376; 172/484; 172/464

[58] Field of Search ..... 404/128, 130, 132, 85; 172/784, 519, 170, 175, 452, 483, 484; 152/376; 301/36 R

[56] References Cited

U.S. PATENT DOCUMENTS

| | | | |
|---|---|---|---|
| 1,976,235 | 10/1934 | Lawrence | 152/376 X |
| 2,127,075 | 8/1938 | Venosta | 152/376 X |
| 2,199,649 | 5/1940 | Poulter | 404/132 |
| 2,721,405 | 10/1955 | Gardner | 404/128 |
| 2,739,517 | 3/1956 | Roberts | 404/132 |
| 3,463,552 | 8/1969 | Colletti | 152/376 |
| 3,993,413 | 11/1976 | Cox | 172/452 |
| 4,714,295 | 12/1987 | Wirtgen | 172/483 |
| 4,714,295 | 12/1987 | Wirtgen | 172/483 |

FOREIGN PATENT DOCUMENTS

| | | |
|---|---|---|
| 202567 | 5/1955 | Australia . |
| 221328 | 10/1957 | Australia . |
| 573705 | 8/1984 | Australia . |

*Primary Examiner*—Richard J. Johnson

*Attorney, Agent, or Firm*—Oldham & Oldham

[57] ABSTRACT

An arrangement of a roller in combination with a draft vehicle comprising a draft frame, axle means supported by the draft frame, and roller supported by the axle means to allow rotational freedom about a central axis of a cylindrical shape of the roller, the arrangement being characterized in that the draft frame is connected to the draft vehicle by means constraining rotation of the draft frame relative to the draft vehicle about a vertical axis.

1 Claim, 3 Drawing Sheets

ROAD MAKING APPARATUS

This invention relates to rollers and has particular application to road graders and other road making apparatus.

It is conventional to use road graders to scrape and relocate earth using a blade and for the grader to have pulled behind it a roller which has the purpose of tamping down the freshly cut and moved earth.

Such a roller is conventionally connected to the grader by a single pivot connection where the pivot connection allows for rotational motion of a draft frame supporting the roller about a substantially vertical axis A problem that exists is that most actions require some forward motion and then a return motion for another cutting action of the grader.

The problem that arises with such a large device as a road grader is that the grader during the backing movement must be steered so as to maintain the appropriate relative position of the roller during such a backing operation.

In practice the roller may often have to be removed to allow for appropriate backing simply because of the difficulty of manipulating the grader to ensure that the roller does not jack-knife during this backing procedure.

It takes little imagination to understand the very significant difficulty that presently exists both in time and costs that does presently occur with arrangements of this type.

According to this invention there is proposed an arrangement of a roller in combination with a draft vehicle comprising a draft frame, axle means supported by the draft frame and a roller supported by the axle means to allow rotational freedom about a central axis of a cylindrical shape of the roller, the arrangement being characterised in that the draft frame is connected to the draft vehicle by means constraining rotation of the draft frame relative to the draft vehicle about a vertical axis.

In preference, the means connecting the draft frame to the draft vehicle include at least two releasable interconnecting connections which are spaced apart in a direction lateral to a forward direction of the roller whereby the draft frame is interlocked with respect to the draft vehicle about any vertical axis whereby rotation about said vertical axis relative to the draft vehicle is completely restrained.

In preference, there are means allowing for the relative rotation of the draft frame together with the axle means and the supported roller about an axis transverse to a forward direction whereby the roller can be lifted or lowered relative to the draft vehicle.

In preference, the draft vehicle is a road grader and the means for providing support of the roller is a three-point linkage.

In preference, the cylindrical shape of the roller is provided by a plurality of pneumatic tyres in adjoining coaxial alignment.

In preference, there is a common pressure conduit coupled to each of the pneumatic tyres whereby each will be inflated upon a common pressure being applied to the conduit to the same pressure.

For a better understanding of this invention it will now be described with reference to drawings in which:

FIG. 6 is a schematic rear view of a roller according to the preferred embodiment, showing a common conduit for filling the tyres and non-return valve associated therewith.

Figure 2:
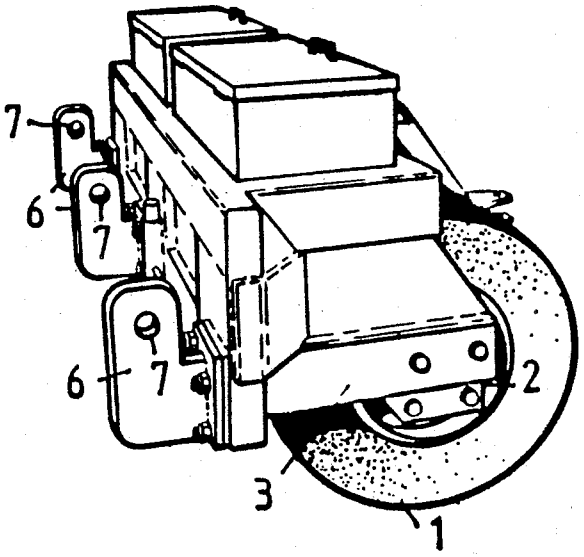
FIG. 2 is a perspective view from a front side of the same embodiment as shown in FIG. 1.
Figure 1:
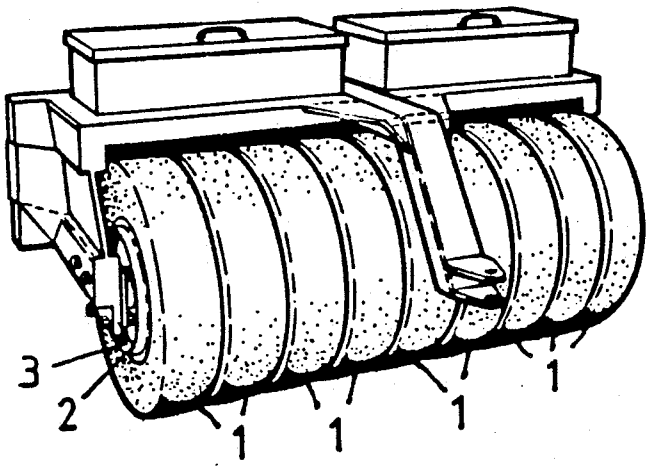
FIG. 1 is a rear view of a roller according to the preferred embodiment.
Figure 3:
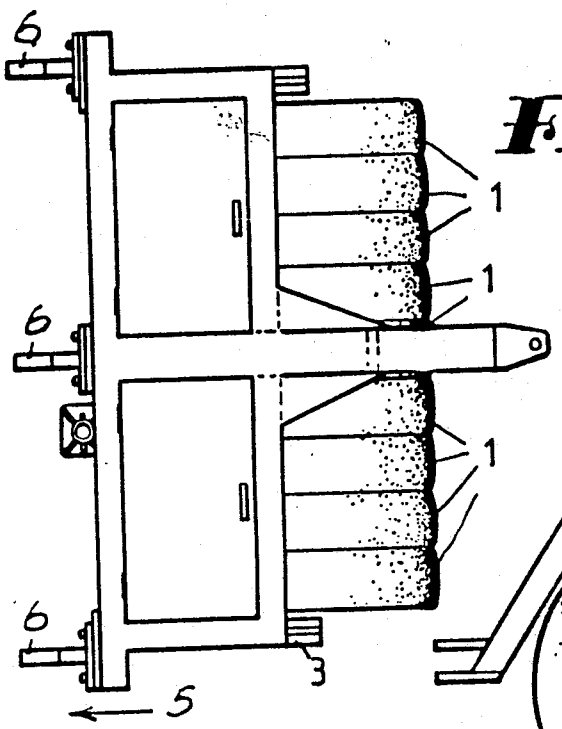
FIG. 3 is a plan view of the same embodiment as shown in FIGS. 1 and 2.
Figure 4:
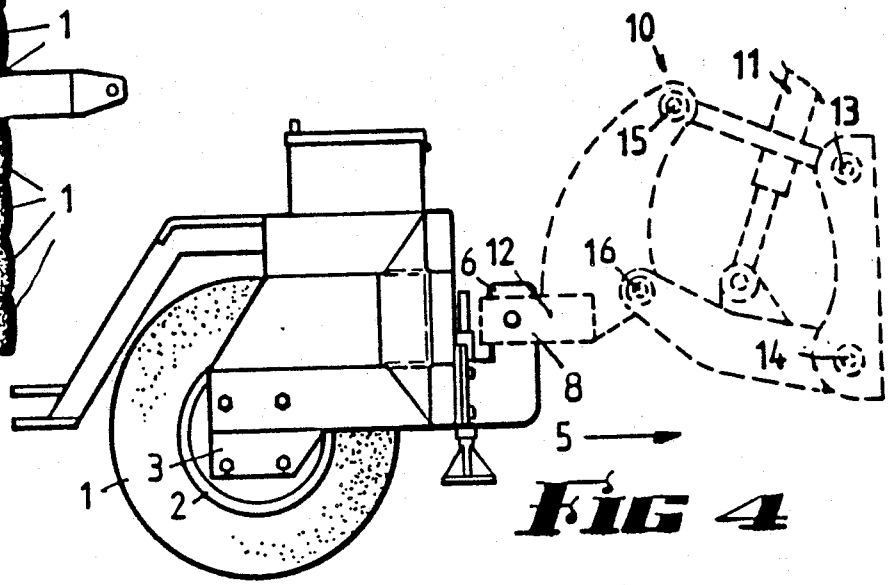
FIG. 4 is a side elevation showing the roller as shown in FIGS. 1, 2 and 3 coupled to the lifting mechanism of a road grader as shown in outline.
Figure 5:
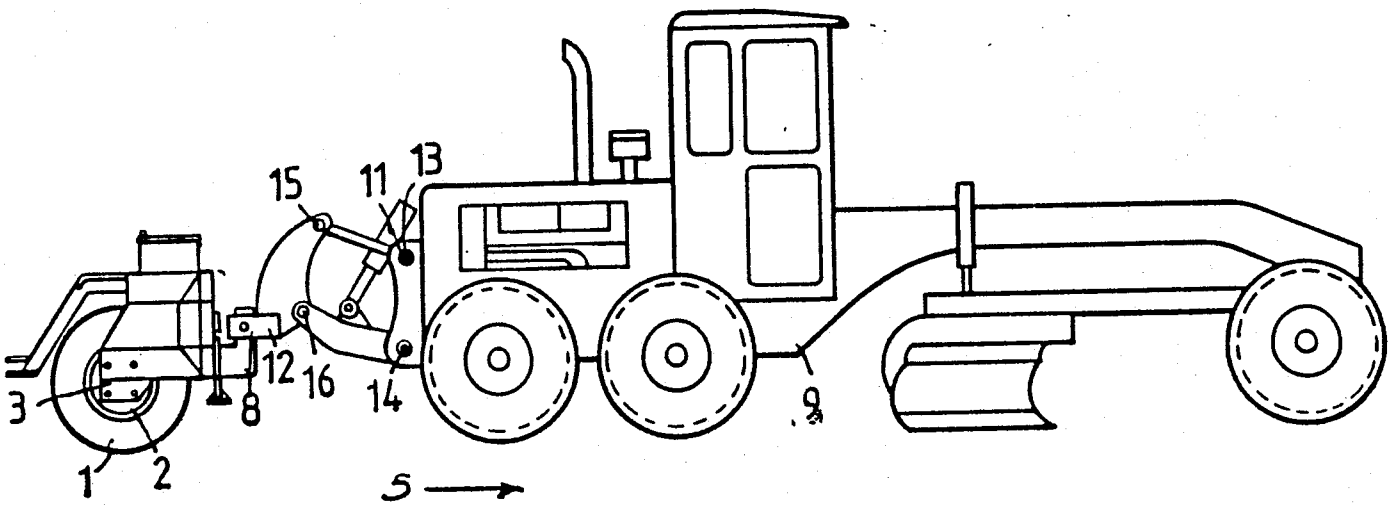
FIG. 5 is a side elevation showing in full a road grader together with the roller in accord with the embodiment as shown in FIGS. 1, 2, 3 and 4.

Referring in detail to the drawings, the roller includes a plurality of inflatable tyres 1 which are supported on a single axle 2 which in turn is supported by a draft frame 3 such that the roller shape thus formed as a cylindrical shape is supported for rotational motion about its own cylindrical axis which in turn is adapted to be drawn so as to be rotatable about the axis which is transverse to a forward direction as shown at 5.

Each of the tyres 1 is pneumatically coupled to a common conduit 17 which has a single non-return valve 18 so that each of the tyres can be inflated to a common pressure and will each hold such common pressure.

The result of this is that when a significant pressure is applied to the roller, the pressure will cause each of the tyres to conform to the shape being rolled more readily and with a common pressure, if there is for instance a crown shape in the road, then the tyres at the centre of the roller may well more easily conform to such a shape with the tyres at each side compensating in shape.

Of particular interest in respect of this embodiment are the forwardly and upwardly extending arms 6 each of which have transversely extending aperture 7.

These are each adapted to fit into an appropriate socket 8 of a grader 9.

Each of the sockets 8 are located on a common transverse bar 12 which in turn is supported by a linkage coupling system as shown at 10 such that hydraulic ram 11 will cause the bar 12 to lift relative to the ground or be lowered relative to the ground as appropriate.

The pivot coupling is governed by pivots at 13, 14, 15 and 16.

In use with this arrangement, the grader can be operated so as to cause the roller to be forced into a lowermost position thereby in effect transferring some of the weight from the grader onto the roller increasing thereby the rolling effect of the roller.

As a converse arrangement, when required, the roller can be lifted and by reason of the relative location of the pivot points 13, 14, 15 and 16 and the respective lengths of the links, this will in effect cause the roller to be lifted and be rotatable about a horizontal axis transverse to a forward direction of the grader.

It is to be noted that the locking of the arms 6 which are spaced apart in a lateral direction with respect to receiving sockets on the road grader 9, will ensure that the roller is constrained from rotating about any vertical axis relative to the grader 9.

In this way the grader can be backed and it is found that the roller will be forced to simply hold its relative orientation with respect to the grader and especially insofar that this will simply then slide over the ground as appropriate, or indeed additionally roll over the ground, there is neither difficulty for the roller or the driver in such a manoeuvre.

Some lifting of the roller including reduction of the pressure of the roller can be provided where appropriate but in most cases is no longer necessary.

The claims defining the invention are as follows.

1. A roller in combination with a draft vehicle, comprising a draft frame, axle means supported by the draft frame, and a roller supported by the axle means to allow rotational freedom about a central axis of the roller, said roller comprising a plurality of pneumatic tires in adjoining coaxial alignment, a common pressure conduit coupled to each of the pneumatic tires whereby each may be inflated and maintained at a common pressure, said draft vehicle comprising a transverse bar secured by lift linkage to the vehicle, said transverse bar having a plurality of vertically oriented transversely spaced openings, the arrangement being characterized in that the draft frame is connected to the transverse bar by connecting means preventing rotation of the draft frame relative to the draft vehicle about a vertical axis, said connecting means comprising vertically oriented arms rigidly secured to and extending forwardly from said roller and being detachably secured in said transverse bar openings, whereby said roller draft frame may be raised and lowered by said vehicle lift linkage.

* * * * *

UNITED STATES PATENT AND TRADEMARK OFFICE

CERTIFICATE OF CORRECTION

PATENT NO. : 4,909,663

DATED : March 20, 1990

INVENTOR(S) : Peter D. Freeman

It is certified that error appears in the above-identified patent and that said Letters Patent is hereby corrected as shown below:

The title page showing the illustrative figure should be deleted to appear as per attached title page.

Signed and Sealed this

Seventeenth Day of December, 1991

*Attest:*

HARRY F. MANBECK, JR.

*Attesting Officer*

*Commissioner of Patents and Trademarks*

United States Patent [19]

Freeman

[11] Patent Number: 4,909,663

[45] Date of Patent: Mar. 20, 1990

[54] ROAD MAKING APPARATUS

[76] Inventor: Peter D. Freeman, Wirrulla, South Australia, Australia

[21] Appl. No.: 137,865

[22] Filed: Dec. 24, 1987

[51] Int. Cl.[4] ..... E01C 19/26

[52] U.S. Cl. ..... 404/128; 152/376; 172/484; 172/464

[58] Field of Search ..... 404/128, 130, 132, 85; 172/784, 519, 170, 175, 452, 483, 484; 152/376; 301/36 R

[56] References Cited

U.S. PATENT DOCUMENTS

| | | | |
|---|---|---|---|
| 1,976,235 | 10/1934 | Lawrence | 152/376 X |
| 2,127,075 | 8/1938 | Venosta | 152/376 X |
| 2,199,649 | 5/1940 | Poulter | 404/132 |
| 2,721,405 | 10/1955 | Gardner | 404/128 |
| 2,739,517 | 3/1956 | Roberts | 404/132 |
| 3,463,552 | 8/1969 | Colletti | 152/376 |
| 3,993,413 | 11/1976 | Cox | 172/452 |
| 4,714,295 | 12/1987 | Wirtgen | 172/483 |
| 4,714,295 | 12/1987 | Wirtgen | 172/483 |

FOREIGN PATENT DOCUMENTS

| | | |
|---|---|---|
| 202567 | 5/1955 | Australia . |
| 221328 | 10/1957 | Australia . |
| 573705 | 8/1984 | Australia . |

*Primary Examiner*—Richard J. Johnson
*Attorney, Agent, or Firm*—Oldham & Oldham

[57] ABSTRACT

An arrangement of a roller in combination with a draft vehicle comprising a draft frame, axle means supported by the draft frame, and roller supported by the axle means to allow rotational freedom about a central axis of a cylindrical shape of the roller, the arrangement being characterized in that the draft frame is connected to the draft vehicle by means constraining rotation of the draft frame relative to the draft vehicle about a vertical axis.

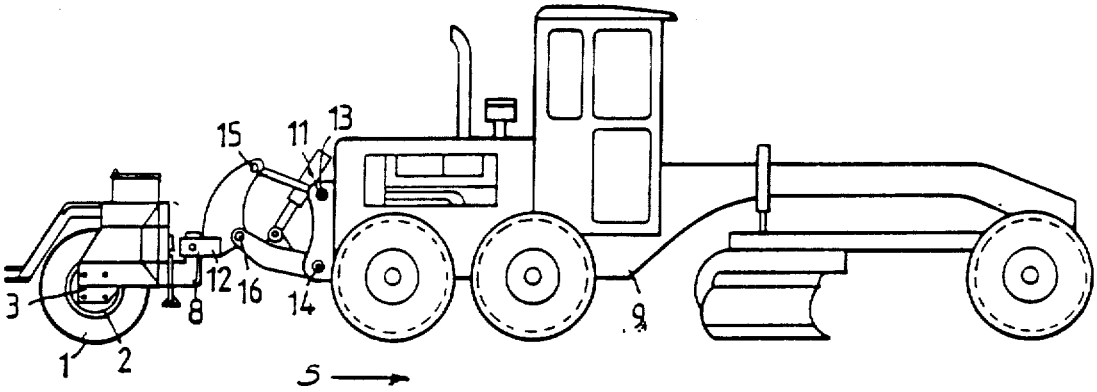

1 Claim, 3 Drawing Sheets